US005803832A

United States Patent [19]

Nakamura et al.

[11] Patent Number: 5,803,832

[45] Date of Patent: Sep. 8, 1998

[54] SOLID GOLF BALL

[75] Inventors: Atsushi Nakamura; Hisashi Yamagishi, both of Chichibu, Japan

[73] Assignee: Bridgestone Sports Co., Ltd., Tokyo, Japan

[21] Appl. No.: 738,828

[22] Filed: Oct. 28, 1996

[30] Foreign Application Priority Data

Oct. 26, 1995 [JP] Japan ..... 7-302012

[51] Int. Cl.[6] ..... A63B 37/06; A63B 37/12

[52] U.S. Cl. ..... 473/377; 473/372; 473/378

[58] Field of Search ..... 473/377, 372, 473/378

[56] References Cited

U.S. PATENT DOCUMENTS 5,439,227 8/1995 Egashira et al. ..... 473/377 X
5,497,996 3/1996 Catorniga ..... 473/365

*Primary Examiner*—George J. Marlo
*Attorney, Agent, or Firm*—Sughrue, Mion, Zinn, Macpeak & Seas, PLLC

[57] ABSTRACT

In a solid golf ball comprising a solid core and a cover and having a weight of 41–44.5 grams, the solid core has a distortion of δ mm, typically 3–6 mm under a load of 100 kg and the cover has a Shore D hardness d, typically 50–65 degrees, which satisfy $d \leqq -4.6 \times \delta + 83.4$. The relationship between core hardness and cover hardness is optimized for shots at low head speeds of less than 40 m/sec.

3 Claims, 2 Drawing Sheets

SOLID GOLF BALL

BACKGROUND OF THE INVENTION

1. Field of the Invention

This invention relates to a solid golf ball and more particularly, to a solid golf ball which will travel a longer distance when hit at a relatively low head speed, is improved in feel and durability, and is thus suitable for golf players with a low head speed including beginner, female and senior players.

2. Prior Art

For golf balls, various proposals have been made for improving their flying distance and hitting feel. This is also true for solid golf balls.

Most of these advanced golf balls target those golf players who swing at a relatively high head speed of 45 m/sec. or higher, that is, experienced players. Then those golf players capable of high head speed swing can take advantage of the advanced balls, enjoying an increased flying distance and a pleasant feeling. However, those golf players who are slow in head speed, including beginner, female and senior players cannot take full advantage of the advanced balls. The reason is that the flight performance is more dependent on a head speed since a weaker force applied to the ball upon impact causes a smaller deformation to the ball.

Usually, players with a slow head speed select lighter or softer ones of the advanced balls. Since these balls, however, are not originally designed optimum for slow-headspeed players, the balls not only follow a low trajectory rather than a high trajectory upon hitting, failing to extend a flying distance, but also offer a less pleasant feel upon hitting. Also the balls are not satisfactorily durable.

There is a desire to have a solid golf ball best suited for golf players with a low head speed.

SUMMARY OF THE INVENTION

An object of the present invention is to provide a novel and improved solid golf ball which will travel a longer distance due to increased restitution when hit at a relatively low head speed, is improved in feel and durability, and is thus suitable for players with a low head speed.

The present invention provides a solid golf ball comprising a solid core and a cover. The ball has a weight of 41 to 44.5 grams. The solid core has a distortion of δ mm under a load of 100 kg and the cover has a Shore D hardness d which satisfy the expression (1):

$$d \leqq -4.6\times\delta+83.4 \quad (1)$$

BRIEF DESCRIPTION OF THE DRAWINGS

These and further features of the present invention will be apparent with reference to the following description and drawings, wherein.

DETAILED DESCRIPTION OF THE INVENTION

Through the research work, we have got the following findings.

(i) Upon hitting at a low head speed, a relatively light ball will fly higher and is expected to travel a longer distance.

(ii) A relatively soft ball is suited for hitting at a low head speed. Since hitting at a low head speed gives a smaller force to the ball upon impact, a hard ball will undergoes a smaller amount of deformation which exacerbates restitution. In contrast, an appropriately soft ball is efficient to convert ball deformation into a reaction force which favorably serves for increasing the flying distance.

Figures 1A, 1B:
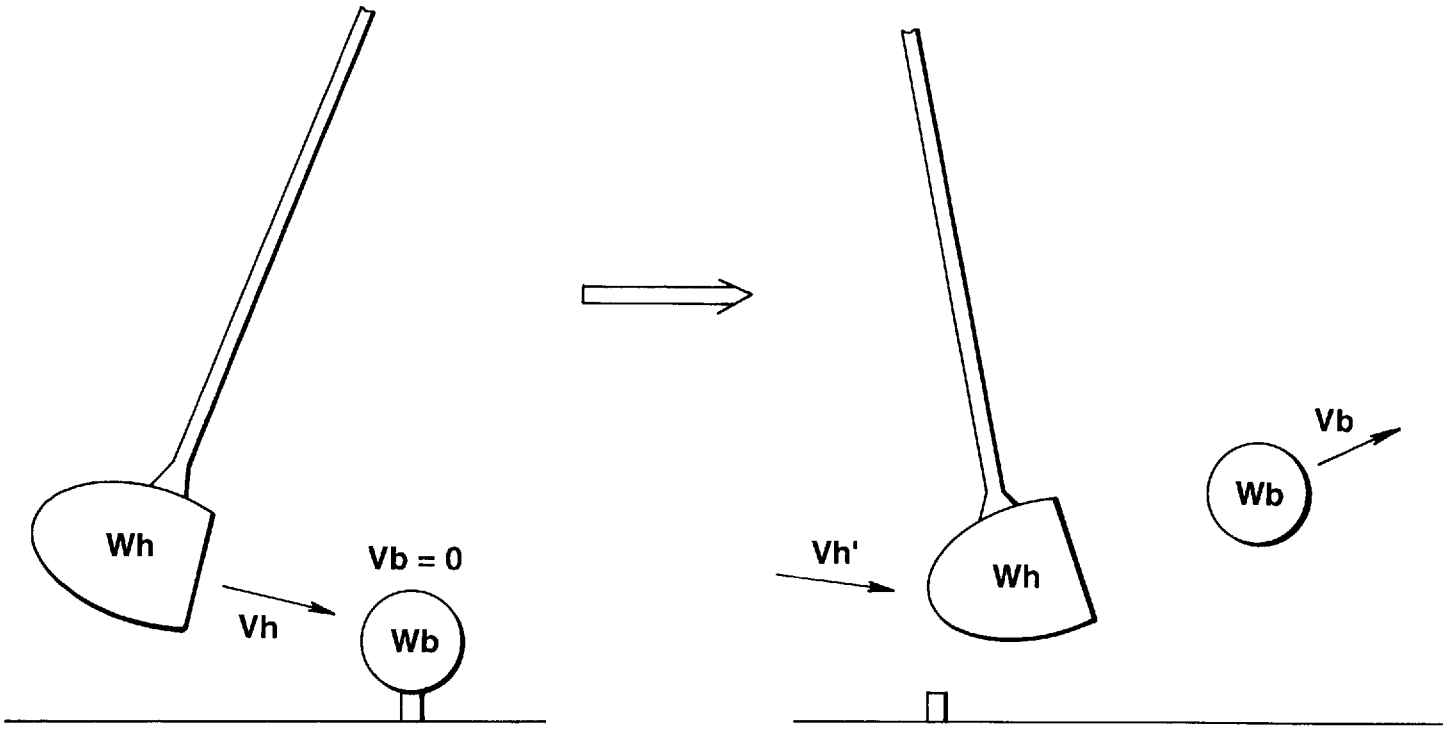
FIGS. 1(*a*) and 1(*b*) are schematic views of a club head and a golf ball before and after impact, respectively.
Figure 2:
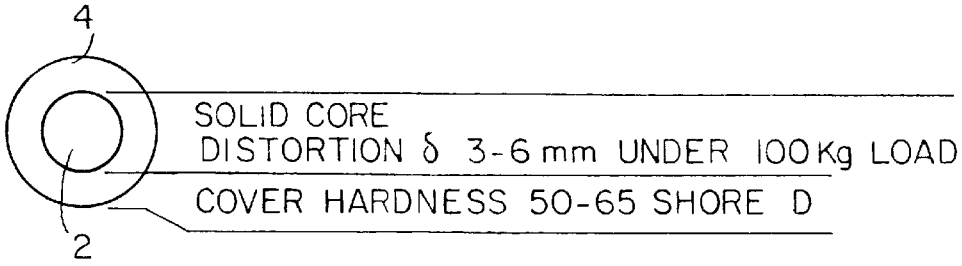
FIG. 2 illustrates the golf ball of the invention.
Figure 3:
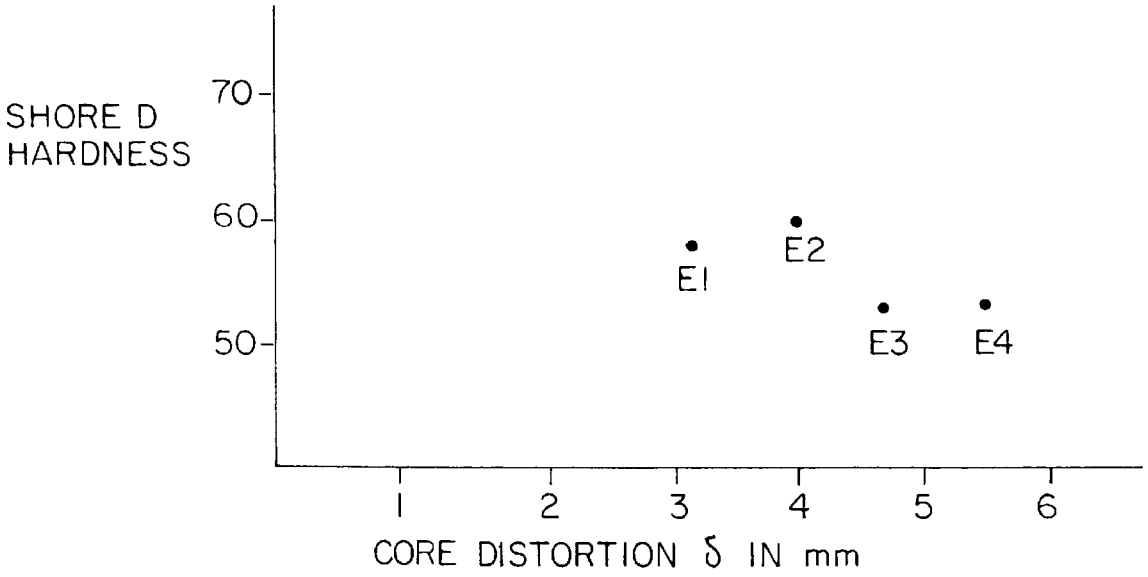
FIG. 3 shows the relationship between the core hardness and the cover hardness in the golf ball of the invention.

(iii) The efficiency of restitution can be improved by reducing the weight of a ball as in (i). Referring to FIGS. 1(*a*) and 1(*b*), the relation between a club head and a ball upon impact is discussed. The club head has a weight Wh and is swung at a head speed Vh before impact and a head speed Vh' after impact. The ball has a weight Wb and a stationary velocity Vb' (=0) before impact and is launched at an initial velocity Vb immediately after impact. The relation of kinetic energy between the club head and the ball gives equation (2).

$$WhVh=WhVh'+WbVb \quad (2)$$

The relation of restitution between the club head and the ball gives equation (3):

$$e=-\frac{Vb-Vh'}{0-Vh} \quad (3)$$

wherein e is a coefficient of restitution determined from the club and the ball. The initial velocity Vb of the ball is then determined from equations (2) and (3) and represented by equation (4).

$$Vb=Vh\frac{1+e}{1+(Wb/Wh)} \quad (4)$$

This suggests that the lower the ball weight Wb, the higher is the initial velocity Vb, provided that the head speed Vh and the club head weight Wh are fixed.

(iv) When it is desired to make the ball soft, the following problems arise with a solid golf ball of a two-piece structure consisting of a core and a cover or multi-piece structure. (a) If the core is made soft, it is generally difficult to insure restitution. A hard cover must then be used at the sacrifice of durability and feel. (b) In the case of (a), it would be effective to reduce the weight of the ball. This requires to reduce the percent loading of filler and increase the rubber fraction, which eventually leads to a soft core with high restitution. Then a soft cover can be used, leading to improvements in durability and feel. (c) It is generally believed that a softer cover leads to a higher spin rate and a shorter flight distance. Since the influence of the hardness (or softness) of the cover on spin is small in the region of soft cores, making the cover relatively soft does not invite a shortage of flight distance.

Based on these findings (i) to (iv), we made a study on a lightweight solid golf ball consisting essentially of a core and a cover in search of the relation between cover hardness and core hardness which is effective for not only improving durability and feeling, but also increasing restitution against impact at low head speeds so as to increase the flight distance. We have found that in a lightweight solid golf ball comprising a solid core and a cover and having a weight of 41 to 44.5 grams, when the hardness of the core and the hardness of the cover are adjusted such that the solid core has a distortion of δ mm under a load of 100 kg and the cover has a Shore D hardness d which satisfy the expression (1):

$$d \leqq -4.6\times\delta+83.4 \quad (1)$$

the ball is not only improved in durability and feeling, but also increased in restitution against impact at low head speeds. An increase of flight distance is effectively accomplished.

Now the present invention is described in further detail.

As mentioned above, in connection with a lightweight solid golf ball consisting essentially of a solid core and a cover enclosing the core, the present invention intends to improve the durability, feel and flying distance upon hitting at low head speeds by optimizing the relation between cover hardness and core hardness.

The solid golf ball of the invention should have a weight of 41 to 44.5 grams, preferably 42 to 44 grams. Balls having a weight of less than 41 grams offer a pleasant hitting feel, but are aerodynamically affected by the wind during flight and fail to cover a long distance because of a too low inertia force. Balls having a weight of more than 44.5 grams have no significant difference from conventional two-piece solid golf balls and cannot exert their performance upon low head speed hitting against the objects of the invention.

In the solid golf ball of the invention, the core hardness and cover hardness are controlled such that the cover's Shore D hardness d satisfies expression (1):

$$d \leqq -4.6 \times \delta + 83.4 \quad (1),$$

wherein δ is a distortion (mm) of the solid core under a load of 100 kg. If the cover's Shore D hardness exceeds the value of d given by expression (1), the cover is too hard, giving a hard or unpleasant hitting feel and inviting a decline of durability.

Although the Shore D hardness of the cover is only required to satisfy expression (1), it is preferred from the standpoint of ball restitution that the Shore D hardness of the cover is 50 to 65 degrees, especially 50 to 60 degrees. If the Shore D hardness of the cover satisfying expression (1) is less than 50 degrees, some balls would provide insufficient restitution. If the Shore D hardness of the cover satisfying expression (1) is more than 65 degrees, there is a risk of exacerbating durability and hitting feel. The gage of the cover is not critical although it preferably has a gage (radial thickness) of 1.4 to 2.4 mm, especially 1.6 to 2.3 mm.

The hardness of the solid core is not particularly limited although the solid core preferably has a hardness corresponding to a distortion δ of 3 to 6 mm, especially 4.7 to 6 mm under a load of 100 kg. Cores with a distortion δ of less than 3 mm would be too hard, resulting in balls presenting unpleasant hitting feel and inadequate for low head speed hitting. Cores with a distortion δ of more than 6 mm would be too soft, losing restitution and durability. The diameter, weight and specific gravity of the solid core are not critical and may be properly adjusted insofar as the objects of the invention are attained. Usually the solid core has a diameter of 38 to 40 mm, especially 38.2 to 39.7 mm and a weight of 24 to 37 grams, especially 25 to 35 grams.

In the golf ball of the invention wherein expression (1) is met, the cover hardness may be adjusted to appropriate softness because durability and hitting feel can be improved without increasing a spin rate upon hitting, especially with a driver and hence, without reducing a flight distance as long as the solid core is in the soft region. More particularly, now that expression (1) is met, the cover hardness may be set at a soft level within the preferred Shore D hardness range of 50 to 65 degrees because durability and hitting feel can be improved without accompanying an unnecessary spin increase and while maintaining a satisfactory flight distance as long as the solid core is in the soft region corresponding to the preferred distortion δ range of 3 to 6 mm.

As mentioned above, the golf ball of the invention is a solid golf ball having a solid core and a cover enclosing the core. It may be a two-piece solid golf ball or a three or multi-piece solid golf ball wherein the core or cover is composed of a plurality of layers. Better results are obtained with two-piece solid golf balls.

In the solid golf ball of the invention, the solid core may be formed of any desired material by any desired method. Any of well-known materials may be used for the core insofar as a golf ball with desirable properties is obtained.

More particularly, the solid core of the solid golf ball according to the invention is formed from a conventional rubber composition by a conventional technique while properly adjusting vulcanizing conditions and formulation. Usually the core is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polybutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 5 to 40 parts by weight of the crosslinking agent is generally blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. Examples of the inert filler include zinc oxide, barium sulfate, silica, calcium carbonate, and zinc carbonate, with zinc oxide and barium sulfate being often used. The amount of the filler blended is preferably 0 to about 30 parts by weight per 100 parts by weight of the base rubber although the amount largely varies with the specific gravity of the core and cover, the standard weight of the ball, and other factors. In the practice of the invention, the amount of the filler (typically zinc oxide and barium sulfate) is properly selected so as to provide the desired hardness and weight to the core.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a solid core.

The cover enclosing the core is formed of a well-known composition, typically based on an ionomer resin. The ball parameters required by the invention are conveniently satisfied by a mixture of two or more ionomer resins. If desired, well-known additives such as titanium dioxide, barium sulfate, and magnesium stearate may be added to the ionomer resin for adjusting a specific gravity and hardness. UV absorbers, antioxidants and dispersing aids such as metal soaps may be added if desired. The cover composition may be molded over the solid core by any desired method, for example, by surrounding the core by a pair of preformed hemispherical cups followed by heat compression molding or by injection molding the cover composition over the core.

Like conventional golf balls, the golf ball of the invention is formed with a multiplicity of dimples in the cover surface. The ball is further subject to finishing steps including buffing, painting and stamping.

The solid golf ball of the invention is constructed as mentioned above. While the diameter of the solid core and the gage of the cover are as defined above, the ball should have a diameter in accordance with the Rules of Golf, that is, a diameter of at least 41.15 mm for the small size and at least 42.67 mm for the large size.

The solid golf ball of the invention is best suited for golfers who swing at a low head speed. The term "low head speed" means a head speed of less than 40 m/sec. when a driver (#W1) is used as a club. Therefore, the solid golf ball of the invention is best suited for golfers with a low head speed of less than 40 m/sec.

According to the present invention, a solid golf ball characterized by a relatively light weight and a relationship between solid core hardness and cover hardness optimized for low head speed hitting exhibits improved durability and feel and will travel a satisfactory flight distance upon low head speed hitting. The ball is best suited for those golf players with a low head speed including beginner, female and senior players.

EXAMPLE

Examples of the present invention are given below by way of illustration and not by way of limitation. All parts are by weight.

EXAMPLES 1–4 & COMPARATIVE EXAMPLES 1–2

A solid core was prepared by milling a solid core-forming rubber composition of the formulation shown in Table 1 in a roll mill and vulcanizing it in a mold at 155° C. for about 20 minutes. A cover-forming composition of the formulation shown in Table 1 was then injection molded over the solid core, obtaining seven golf balls.

It is noted that the golf ball on the surface was formed with two types of large and small dimples arranged in an octahedral pattern so that the dimples occupied 65±3% of the entire surface area.

TABLE 1

| | | E1 | E2 | E3 | E4 | RE | CE1 | CE2 |
|---|---|---|---|---|---|---|---|---|
| Solid core (pbw) | Cis-1,4-polybutadiene rubber | 90 | 90 | 100 | 100 | 100 | 100 | 80 |
| | Polyisoprene rubber | 10 | 10 | | | | | 20 |
| | Zinc acrylate | 25.0 | 23.0 | 21.5 | 19.0 | 20.0 | 23.5 | 25.0 |
| | Zinc oxide | 11.5 | 18.0 | 8.0 | 4.0 | 3.0 | 23.0 | 11.5 |
| | Dicumyl peroxide | 0.9 | 0.9 | 0.9 | 0.9 | 0.9 | 0.9 | 0.9 |

TABLE 1-continued

| | | E1 | E2 | E3 | E4 | RE | CE1 | CE2 |
|---|---|---|---|---|---|---|---|---|
| Cover (pbw) | Surlyn 8220 | | | | | | | 50 |
| | Himilan 7315 | | | | | | | 50 |
| | Himilan 1605 | | 50 | | | | 50 | |
| | Himilan 1557 | 50 | 50 | 60 | 60 | 30 | 50 | |
| | Himilan 1601 | 50 | | | | | | |
| | Surlyn 8120 | | | 40 | 40 | 70 | | |

In Table 1, Surlyn and Himilan are the trade names of ionomer resin commercially available from E. I. duPont and Mitsui duPont Chemical K.K., respectively.

The golf balls were examined for flying performance, feeling, and durability by the following tests.

Flying test

Using a swing robot, the ball was hit by a driver (#W1) at a head speed of 35 m/sec. (HS35) for determining a spin rate, launch angle, carry, total distance, and angle.

Feeling test

Five amateur players with a head speed of 35 m/sec. actually hit the ball to judge the hitting feel. The rating was "◎" for a very soft feel, "○" for a soft feel, and "Δ" for a rather hard feel.

Durability

Using a flywheel hitting machine, the ball was repeatedly hit at a head speed of 38 m/sec. until it was broken. In accordance with the count of hits, the ball was rated "◎" for high durability, "○" for acceptable durability, and "X" for poor durability.

The results are shown in Table 2.

TABLE 2

| | | E1 | E2 | E3 | E4 | RE | CE1 | CE2 |
|---|---|---|---|---|---|---|---|---|
| Core hardness δ (mm) | | 3.2 | 4.0 | 4.7 | 5.5 | 5.5 | 3.5 | 4.0 |
| Cover Shore D hardness | | 58 | 60 | 53 | 53 | 48 | 60 | 68 |
| Ball weight (g) | | 43.40 | 44.00 | 42.20 | 41.50 | 41.50 | 45.30 | 43.50 |
| #W1/HS35 | Spin (rpm) | 4520 | 4237 | 3736 | 3352 | 3580 | 4445 | 4210 |
| | Launch angle (°) | 10.9 | 11.2 | 11.3 | 11.5 | 11.4 | 10.9 | 11.1 |
| | Carry (m) | 148.1 | 148.2 | 147.8 | 148.5 | 144.4 | 146.0 | 148.0 |
| | Total (m) | 163.3 | 162.0 | 161.8 | 163.0 | 158.2 | 161.0 | 161.5 |
| | Angle (°C.) | 13.0 | 12.9 | 13.1 | 13.2 | 13.2 | 12.7 | 13.0 |
| | Feel | ○ | ◎ | ◎ | ◎ | ◎ | Δ | ○ |
| Durability | | ◎ | ◎ | ◎ | ○ | ◎ | ◎ | x |

As is evident from Table 2, the golf ball of Comparative Example 1 having a greater weight did not fly a long distance and presented a less pleasant hitting feel. The ball of Comparative Example 2 was less durable since its cover was too hard to establish a good balance between core hardness and cover hardness. In contrast, the golf balls of Examples 1 to 4 offered an increased flight distance despite a low head speed of 35 m/sec., a pleasant hitting feel, and durability. Note that Reference Example (abbreviated as RE) has the same ball parameters as Example 4 except that the cover hardness is extremely low. The ball of Reference Example gave far superior results to the balls of Comparative Examples 1 and 2 with respect to hitting feel and durability although it had a tendency of traveling a short distance due to the cover's softness.

Japanese Patent Application No. 7-302012 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A solid golf ball comprising a solid core and a cover wherein said solid core has a distortion of δ mm under a load of 100 kg and said cover has a Shore D hardness d which satisfy the expression: $d \leqq -4.6 \times \delta + 83.4$ and the ball has a weight of 41 to 44.5 grams.

2. The solid golf ball of claim 1 wherein said solid core has a distortion δ of 3 to 6 mm under a load of 100 kg.

3. The solid golf ball of claim 2 wherein said cover has a Shore D hardness d of 50 to 65.

* * * * *